US011766145B1

(12) United States Patent
Alexander et al.

(10) Patent No.: US 11,766,145 B1
(45) Date of Patent: Sep. 26, 2023

(54) REUSABLE CONTAINER HOLDER

(71) Applicant: RIPL EFEK LLC, Cheyenne, WY (US)

(72) Inventors: Shawnique Alexander, Cheyenne, WY (US); Sam Ristich, Los Angeles, CA (US)

(73) Assignee: RIPL EFEK LLC, Cheyenne, WY (US)

( * ) Notice: Subject to any disclaimer, the term of this patent is extended or adjusted under 35 U.S.C. 154(b) by 0 days.

(21) Appl. No.: 17/889,537

(22) Filed: Aug. 17, 2022

(51) Int. Cl.
*A47G 23/02* (2006.01)
*B65D 47/06* (2006.01)

(52) U.S. Cl.
CPC ..... *A47G 23/0266* (2013.01); *B65D 47/06* (2013.01)

(58) Field of Classification Search
CPC ..... A47G 23/0266; A47G 23/0208; A47G 23/0216; B65D 47/06; B65D 47/04; B65D 47/00
See application file for complete search history.

(56) References Cited

U.S. PATENT DOCUMENTS

| | | | | |
|---|---|---|---|---|
| 5,143,261 | A * | 9/1992 | Drobish | G01F 11/262 222/455 |
| 10,005,608 | B1 * | 6/2018 | Jacob | B65D 81/3881 |
| 10,444,049 | B1 * | 10/2019 | Ghezzi | B65D 5/746 |
| 2018/0050849 | A1 * | 2/2018 | Egan | B65D 51/18 |
| 2022/0281660 | A1 * | 9/2022 | Kramarenko | B65D 47/06 |

* cited by examiner

*Primary Examiner* — Javier A Pagan
(74) *Attorney, Agent, or Firm* — Cohen IP Law Group, PC; Michael N. Cohen

(57) ABSTRACT

A reusable container holder is provided. In some embodiments, the container includes a recyclable can and the holder includes a housing in which the can is held. The assembly also includes a locking assembly designed to lock the can within the holder until intentionally removed, and a sealing assembly designed to ensure that the interface between the can (when opened) and the holder is fluid-tight. In use, a can of fluid (e.g., liquid detergent) is first opened and then inserted into the reusable container holder. Once placed in its proper position within the holder, the can is automatically locked and sealed in place. The holder includes a removable top cap that once removed allows the fluid from the can to be poured. When the can is empty, the can is release from the holder so that a new can may be inserted.

12 Claims, 15 Drawing Sheets

REUSABLE CONTAINER HOLDER

FIELD OF THE INVENTION

This invention relates to containers, including a reusable holder for cans.

BACKGROUND

According to recent studies, an estimated 583 billion plastic bottles were produced in 2021, most of which were discarded into landfills and/or incinerated after a single use.

Accordingly, there is a need for a reusable container holder. The presently disclosed assembly addresses these needs.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, and according to exemplary embodiments hereof, a reusable container holder is provided. In some embodiments, the container includes a recyclable can and the holder includes a housing in which the can is held. The assembly also includes a locking assembly designed to lock the can within the holder until intentionally removed, and a sealing assembly designed to ensure that the interface between the can (when opened) and the holder is fluid-tight.

In use, a can of fluid (e.g., liquid detergent) is first opened and then inserted into the reusable container holder. Once placed in its proper position within the holder, the can is automatically locked and sealed in place. The holder includes a removable top cap that once removed allows the fluid from the can to be poured. When the can is empty, the can is release from the holder so that a new can may be inserted.

Figure 1:
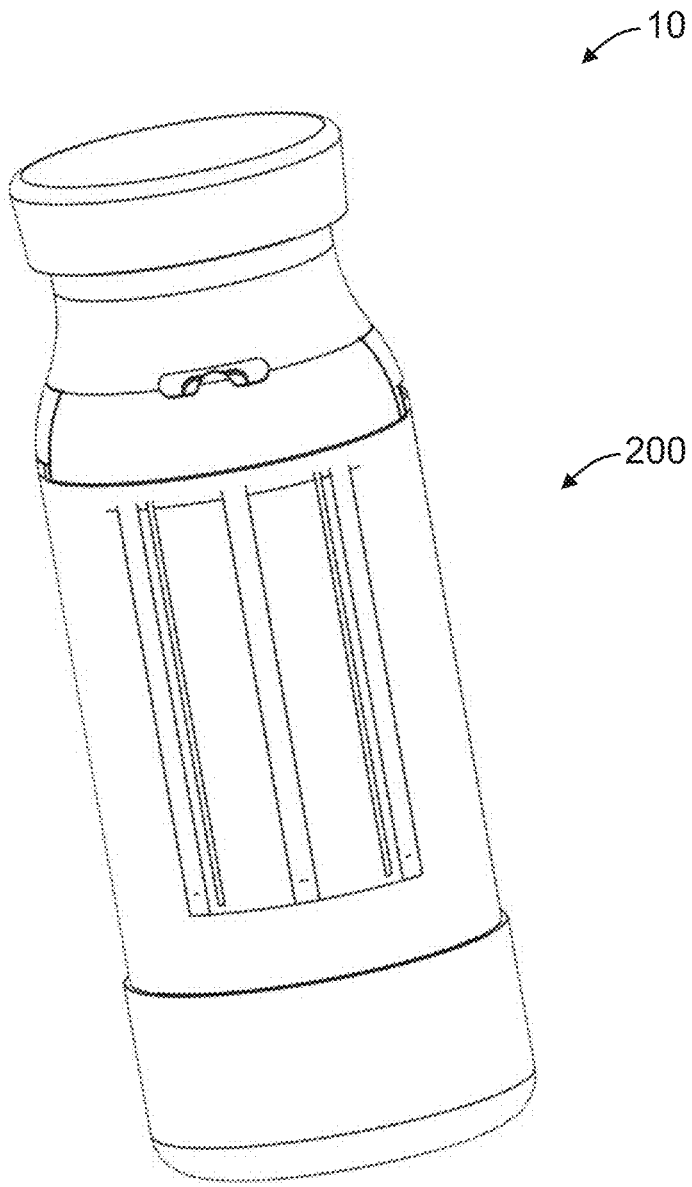
FIG. 1 shows a reusable container holder according to exemplary embodiments hereof.
Figure 2:
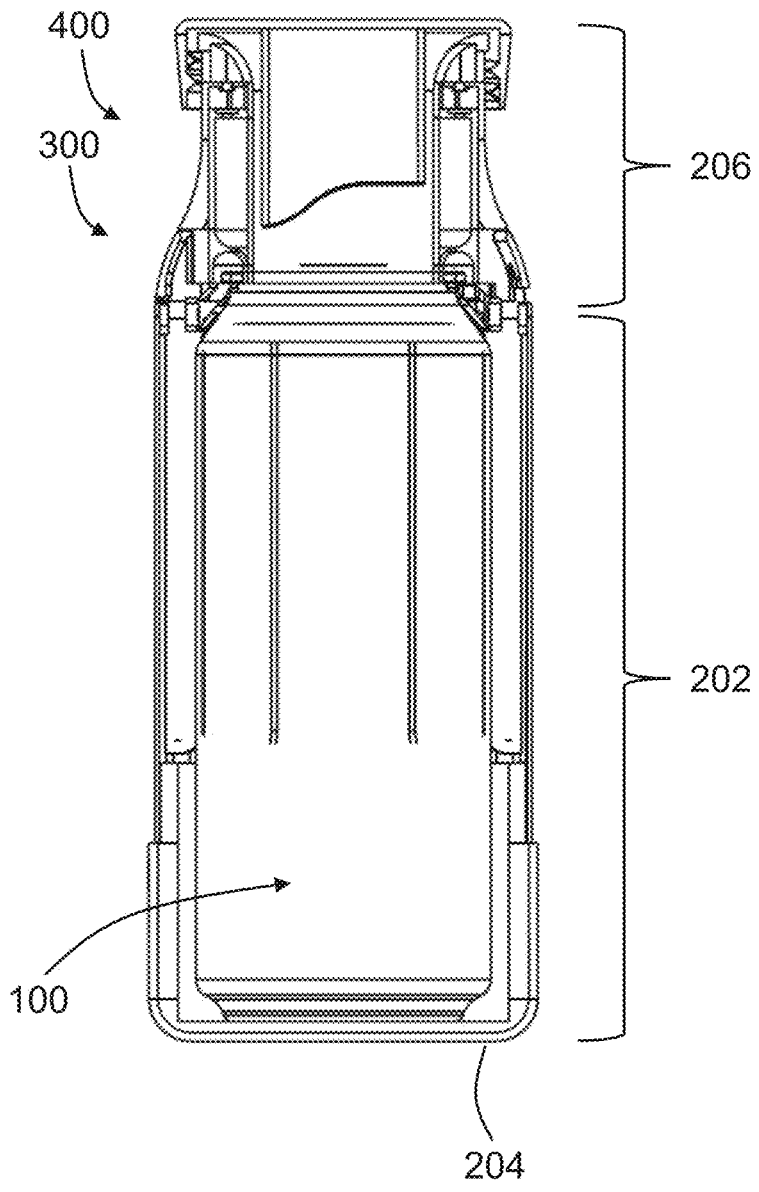
FIG. 2 shows a side sectional view of the reusable container holder of FIG. 1 according to exemplary embodiments hereof.
Figure 3:
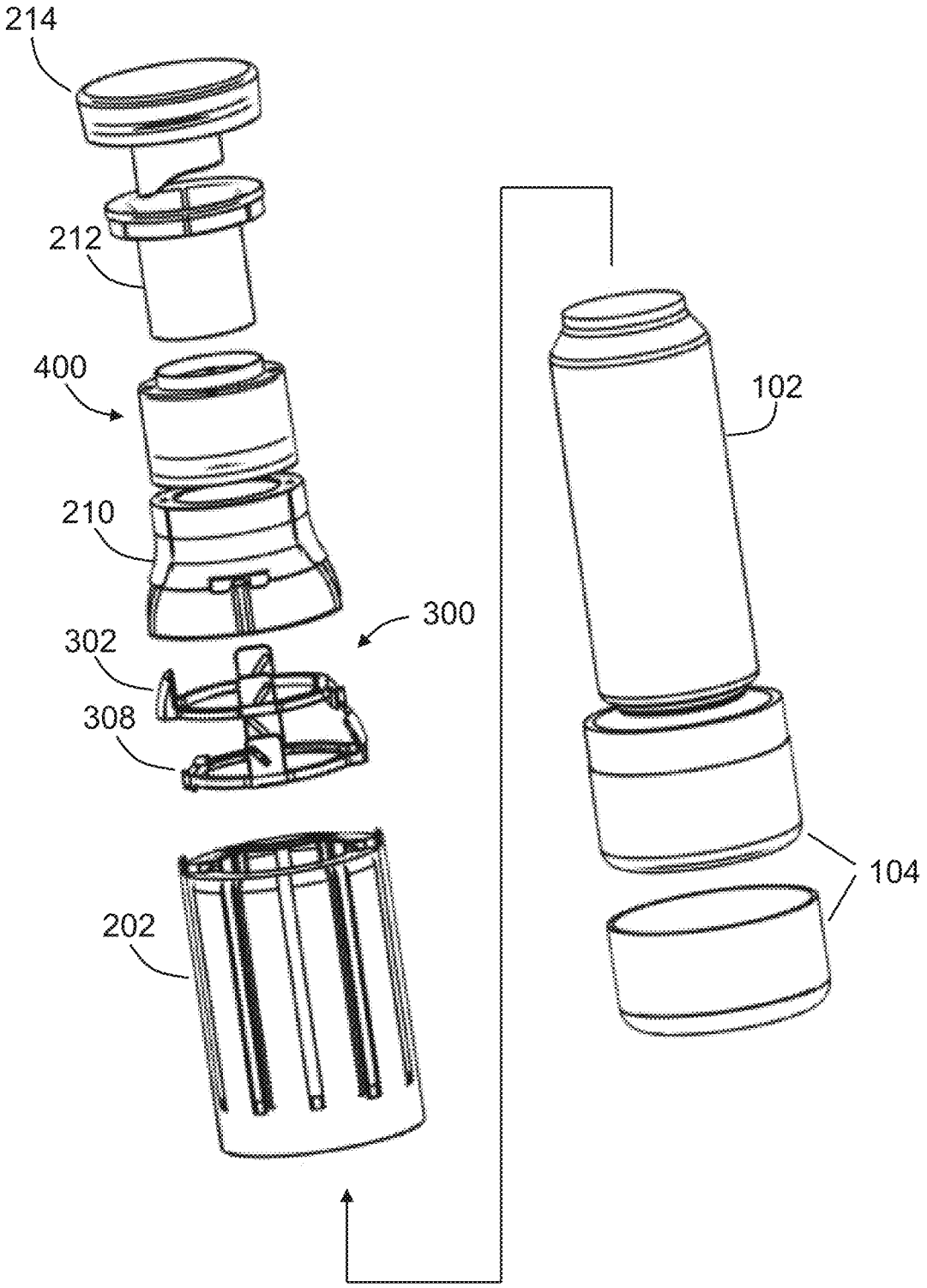
FIG. 3 shows an exploded view of the reusable container holder of FIG. 1 according to exemplary embodiments hereof.

FIG. 1 is a schematic of a reusable container holder assembly 10 according to exemplary embodiments hereof. FIG. 2 is a side sectional view of the assembly 10 of FIG. 1, and FIG. 3 is an exploded view of the same.

In one exemplary embodiment hereof, as shown in FIGS. 1-2, the reusable holder assembly 10 includes a container 100, a housing assembly 200, a locking assembly 300, and a sealing assembly 400. In general, the container 100 is filled with a liquid (e.g., liquid detergent) and is housed within the housing assembly 200. The container 100 is locked within the housing assembly 200 by the locking assembly 300, with the interface between the container 100 and the housing assembly 200 sealed by the sealing assembly 400. The reusable holder assembly 10 also may include other elements and/or components as necessary to perform its functionalities.

For the purposes of this specification, the container 100 will be described primarily as a can, however, it is understood that the container 100 may include other types of containers in any form and/or combination, and that the scope of the assembly 10 is not limited in any way by the type of container 100 that is utilized.

Container 100

Figure 4:
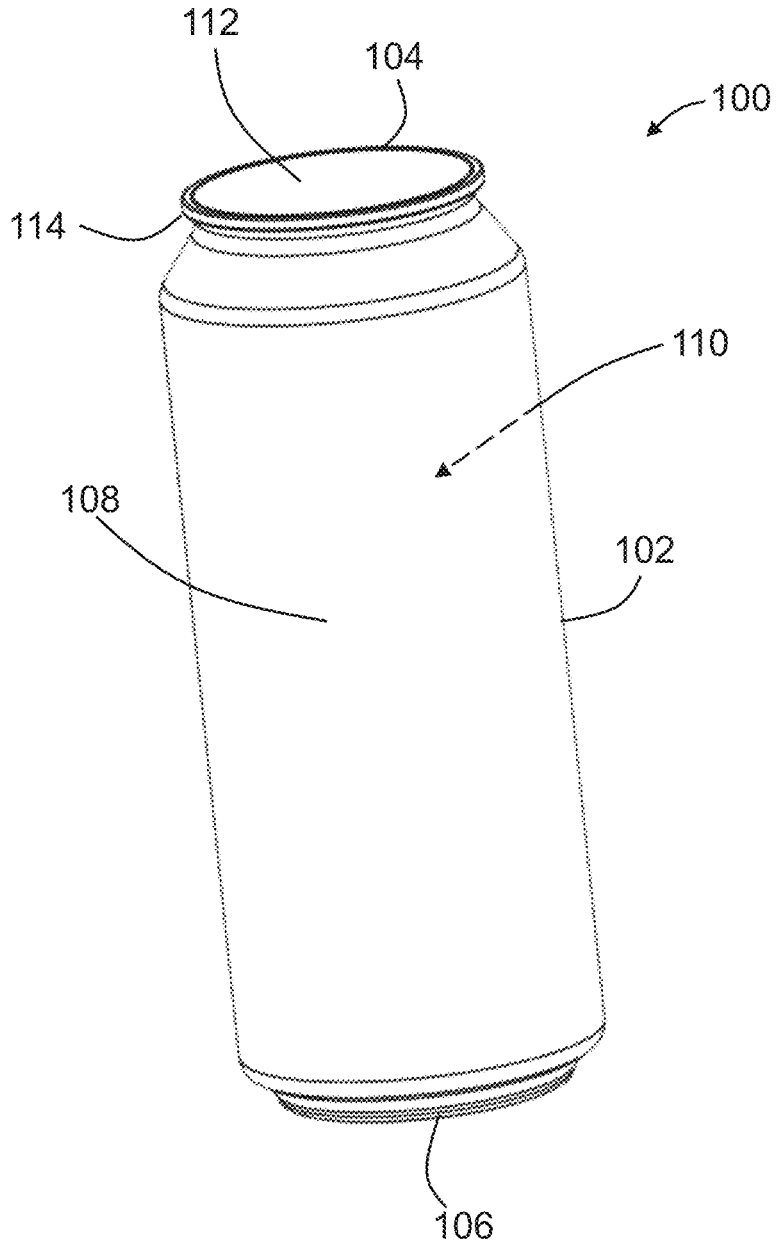
FIG. 4 shows aspects of a container according to exemplary embodiments hereof.

In some embodiments as shown in FIG. 4, the container 100 includes a can 102 including a first end 104 (e.g., a top end), a second end 106 opposite the first end 104 (e.g., a bottom end), and sidewalls 108 that extend between the first and second ends 104, 106 thereby defining a can inner volume 110. While the can 102 shown in FIG. 4 is generally cylindrical, it is understood that the can 102 may be formed as any suitable shape (e.g., octagonal prism)

In some embodiments, the top end 104 includes a removable top surface 112 that when removed generally opens the container 100. The top surface 112 is surrounded (i.e., encircled) by a circumferential rim 114 that remains in place after the top surface 112 is removed. As will be described in other sections, the circumferential rim 114 is utilized when securing the can 102 within the housing 200.

In some embodiments, the can 100 comprises recyclable materials, such as, but not limited to, aluminum, plastic, other types of materials (preferably recyclable), and/or any combinations thereof. In this way, when the can 102 is empty, it may be recycled and replaced with another recyclable can 100.

Housing 200

Figure 5:
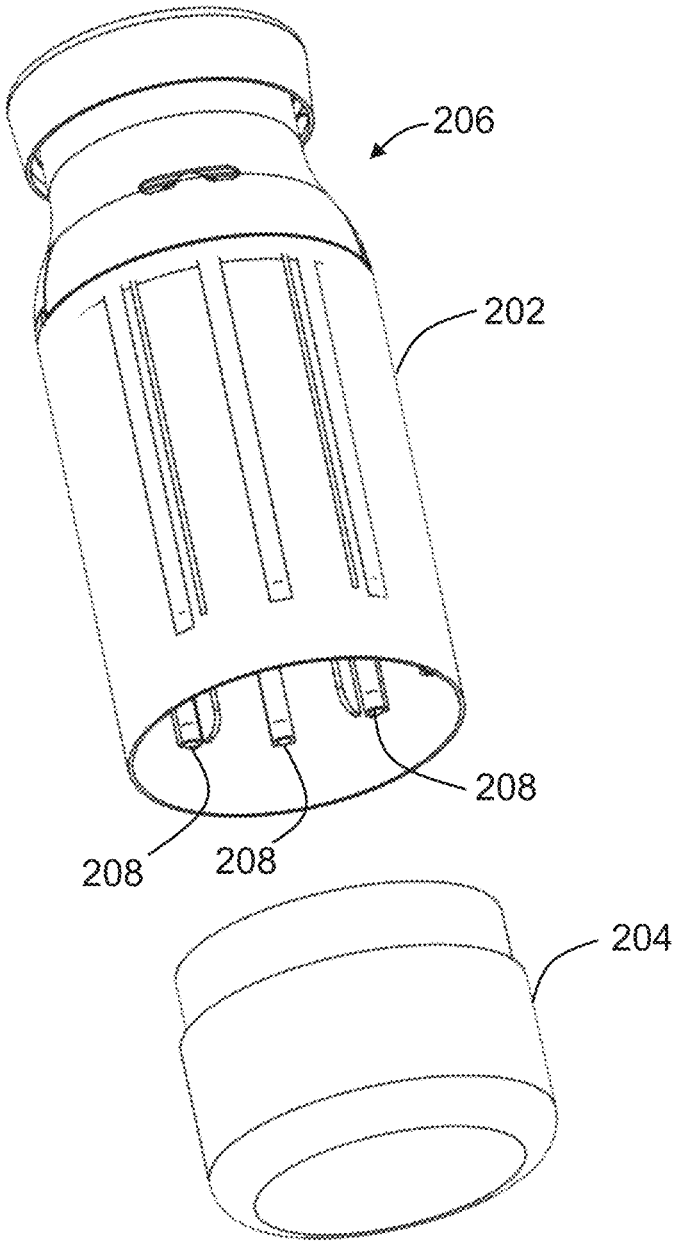
FIG. 5 shows aspects of a reusable container holder according to exemplary embodiments hereof.

In some embodiments, as shown in FIGS. 2 and 5, the housing assembly 200 includes a hollow shell portion 202 including a bottom cap 204 and an upper dispenser portion 206. As will be described in other sections, the locking assembly 300 is located in the area of the upper dispenser portion 206 and is designed to releasably couple the top 104 of the can 102 thereto.

With the bottom cap 204 removed as shown in FIG. 5, the can 102 is inserted into the hollow shell portion 202 from the bottom. Once the can 102 is fully housed within the shell 202 (and locked as will be described in other sections) the cap 204 may be replaced thereby providing a bottom to the assembly 10.

In some embodiments, as shown in FIG. 5, the hollow shell portion 202 includes one or more magnets 208 within its inner volume designed to provide an attractive force to the upper rim of the bottom cap 204 (which preferably comprises a ferromagnetic metal such as iron, nickel, steel, and/or other suitable materials) to hold the cap 204 in place once the can 102 is configured within the shell 202.

Locking Assembly 300

Figure 6:
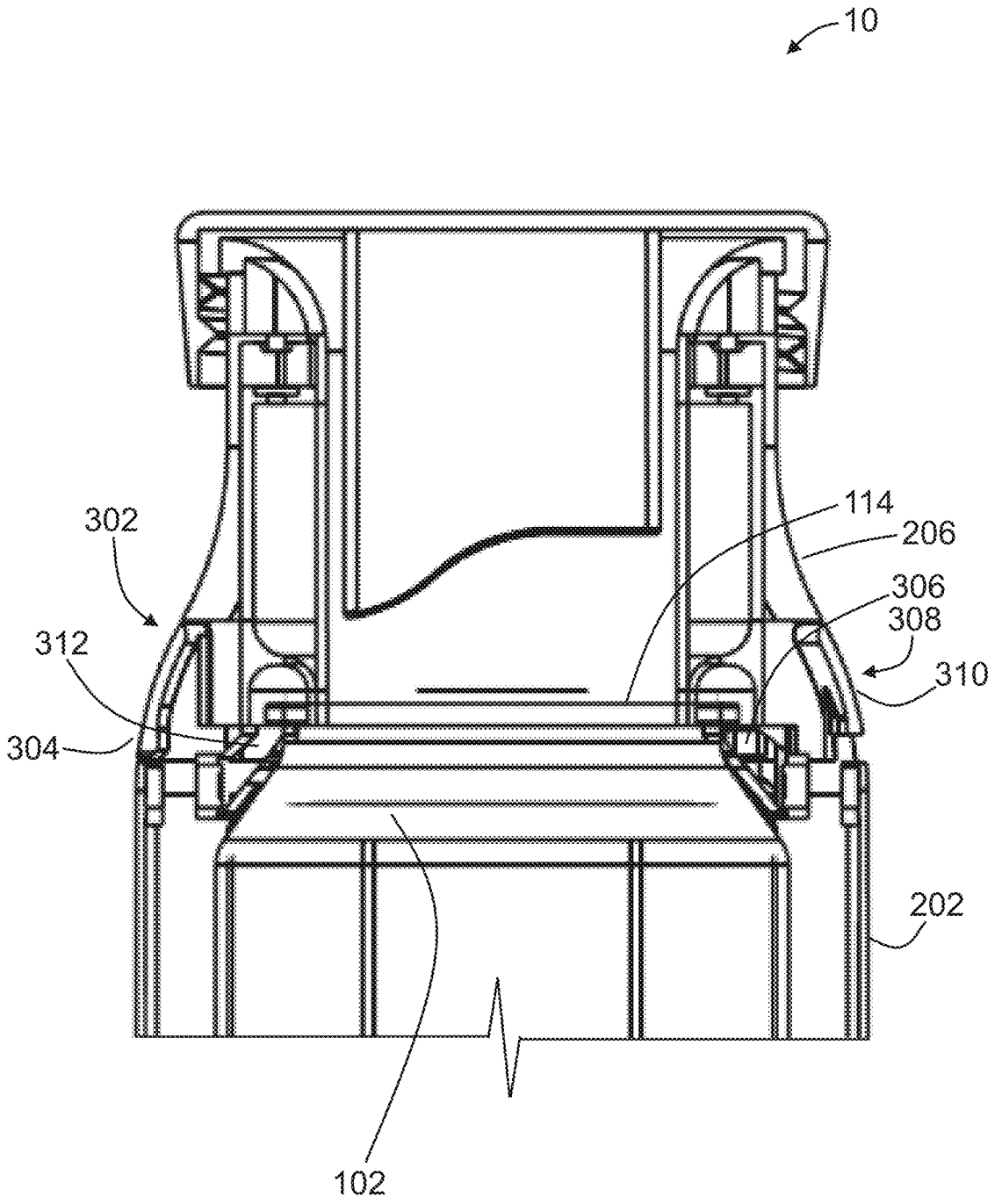
FIGS. 6-10 show aspects of a locking assembly according to exemplary embodiments hereof.

FIG. 6 shows a close-up side sectional view of the can 102 inserted into the shell 202 and held in place by the locking assembly 300. As shown, the locking assembly 300 includes left and right locking tabs 306, 312 that releasably engage the underside of the can's circumferential rim 114 thereby holding it in place.

Figure 7:
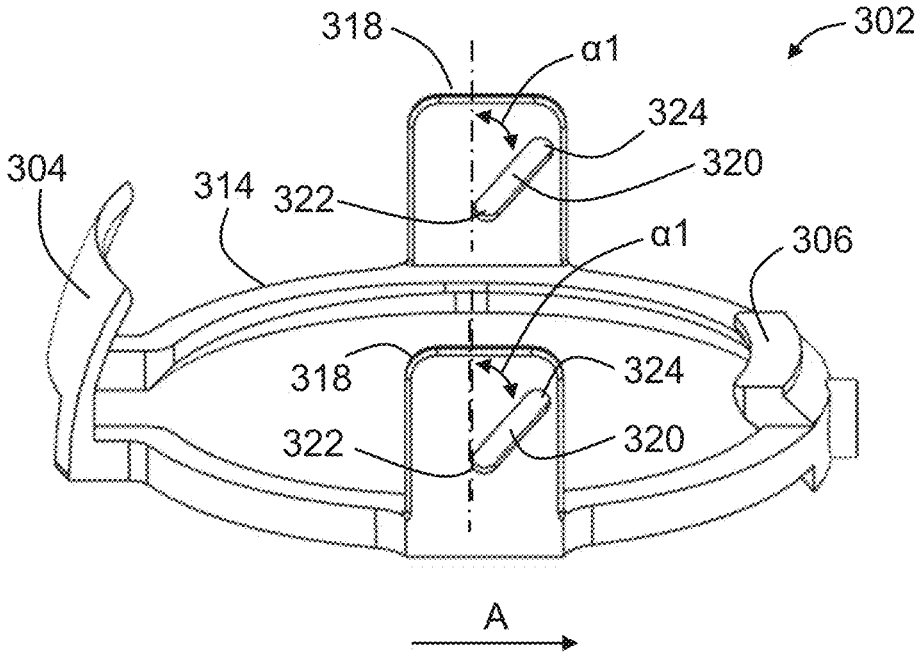
Figure 8:
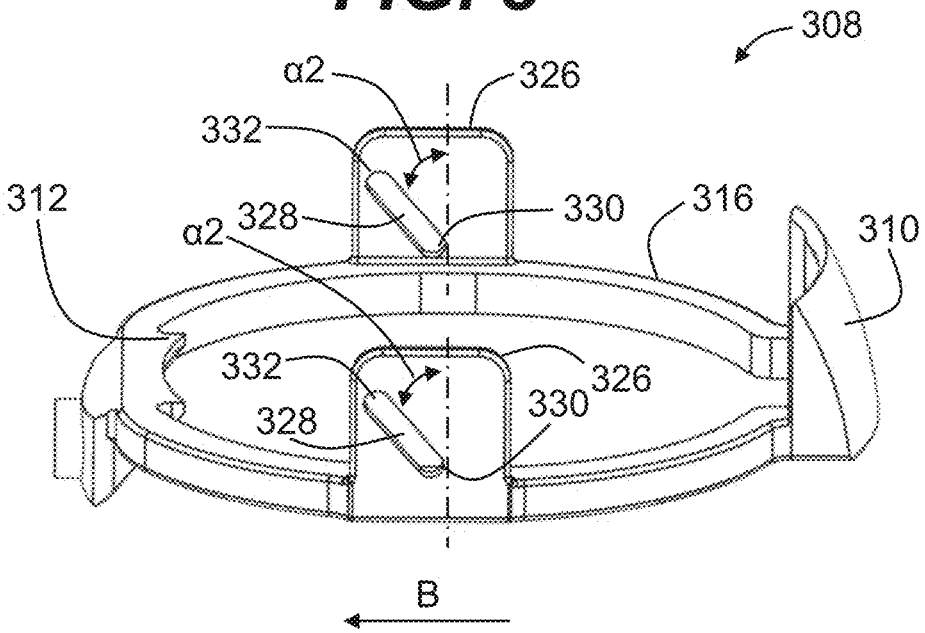

In some embodiments, as shown in FIGS. 6-8, the locking assembly 300 includes a first locking member 302 including a first locking button 304 adapted to activate a first locking tab 306, and a second locking member 308 including a second locking button 310 adapted to activate a second locking tab 312. FIG. 7 shows the first locking member 302 and FIG. 8 shows the second locking member 308, each isolated from the assembly 10 for clarity. Notably, in some embodiments, the first locking tab 306 is located generally on the opposite side of the locking assembly 300 than the first locking button 304, and the second locking tab 312 is located generally on the opposite side of the locking assembly 300 than the second locking button 310.

In some embodiments, as shown in FIG. 7, the first locking member 302 includes a first frame 314 extending between the first locking button 304 and the first locking tab 306 thereby connecting the button 304 and tab 306 together. Given this connection via the first frame 314, as the first button 304 is pushed in the direction of the arrow A (e.g., to the right in FIG. 7), the first locking tab 306 also is forced to translate in the direction of the arrow A. As will be described in other sections, translation of the first locking tab 306 in the direction of the arrow A may dislodge the can's circumferential rim 114 from the first locking tab 306 thereby releasing the can 102 from the first locking member 302.

Similarly, in some embodiments, as shown in FIG. 8, the second locking member 308 includes a second frame 316 extending between the second locking button 310 and the second locking tab 312 thereby connecting the button 310 and tab 312 together. Given this connection via the first frame 316, as the second button 310 is pushed in the direction of the arrow B (e.g., to the left in FIG. 8), the second locking tab 312 also is forced to translate in the direction of the arrow B. As will be described in other sections, translation of the second locking tab 312 in the direction of the arrow B may dislodge the can's circumferential rim 114 from the second locking tab 312 thereby releasing the can 102 from the second locking member 308.

While the frames 314, 316 in FIGS. 7 and 8, respectively, are shown generally as rings, it is understood that the frames 314, 316 may include any suitable shape and/or form (e.g., bars, beams, etc.).

Figure 9:
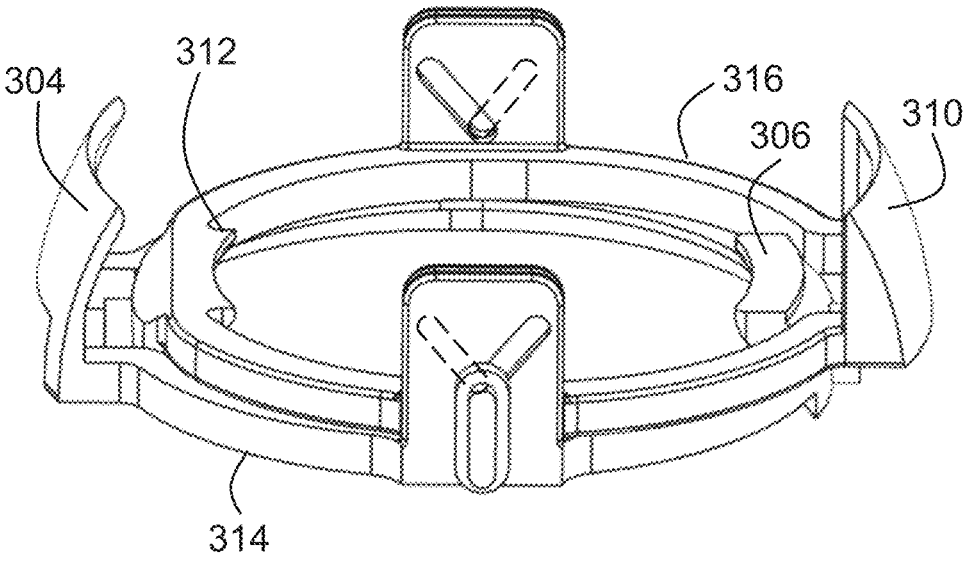

In some embodiments, as shown in FIG. 9, the first and second locking members 302, 308 may be overlaid on top of one another concentrically, e.g., with the second locking member 308 on top of the first locking member 302 (or vice versa), thereby combining the locking members 302, 308. Notably, the arrangement shown in FIG. 9 shows the locking members 302, 308 arranged to lock the can 102 within the housing assembly 200 as described below with respect to FIG. 10.

Figure 10:
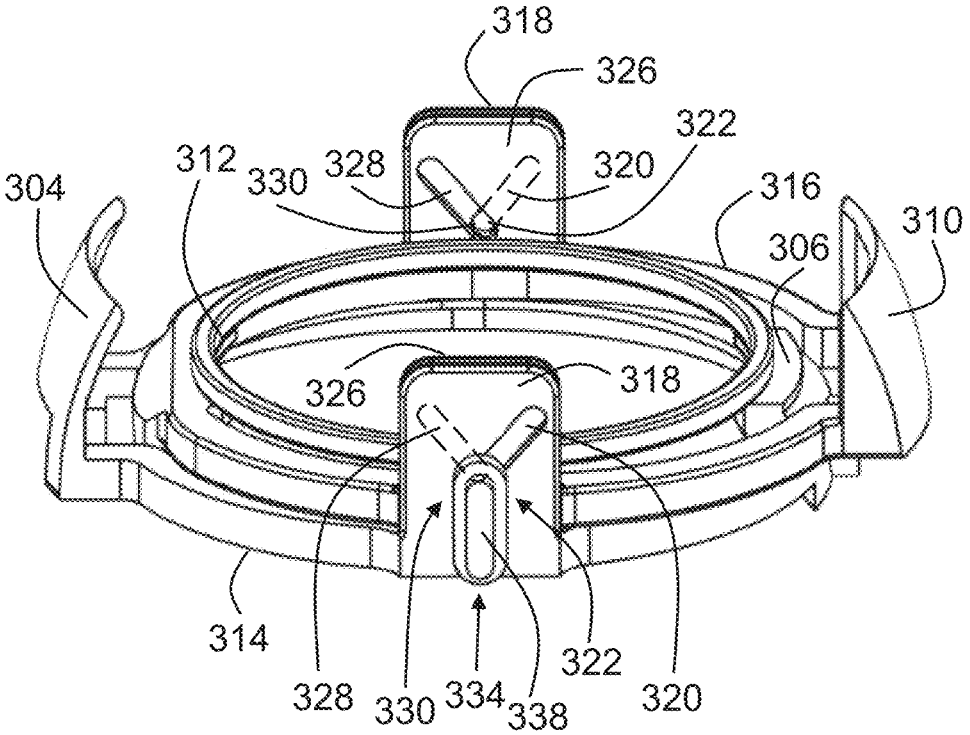

FIG. 10 shows the can's circumferential rim 114 (isolated from the can 102 for clarity) resting on the first and second locking tabs 306, 312, respectively, and thereby locked (prevented) from moving downward and out of the housing 200. As will be described in other sections, the circumferential rim 114 is held from moving upward by the sealing assembly 400 configured with the upper dispenser portion 206 such that the can 102 is held in place within the housing 100 until intentionally released. Then, when the first locking member 302 is moved in the direction of the arrow A (e.g., by pushing in the first locking button 304) and the second locking member 308 is moved in the direction of the arrow B (e.g., by pushing in the second locking button 306), the can 102 is unlocked. In some embodiments, the first and second locking members 302, 308 include spring members designed and positioned to return the first and second locking members 302, 308 to their original positions once the first and second locking buttons 304, 310, respectively, are released. For example, the first locking member 302 may include a spring member disposed between an inner surface of the hollow shell portion 202 or the upper dispenser portion 206 and the first frame 314 (e.g., adjacent the first locking tab 306), and the second locking member 308 may include a spring member disposed between an inner surface of the hollow shell portion 202 or the upper dispenser portion 206 and the second frame 316 (e.g., adjacent the second locking tab 312).

In some embodiments, the first and second locking buttons 304, 316 are designed to only move in the directions of the arrows A and B, respectively, when the buttons 304, 316 are each pushed inward in unison (simultaneously). In this way, the can 102 may only be released when both buttons 304, 316 are pressed inward at the same time thereby ensuring that the can 102 is not released inadvertently.

To accomplish this, in some embodiments, as shown in FIG. 7, the first locking member 302 includes a first control plate 318 coupled to and extending upward from the first frame 314. The first control plate 318 is located between the first locking button 304 and the first locking tab 306, and preferably about midway between the two 304, 314. The first control plate 318 includes a first control slot 320 that passes through the control plate 318 and that traverses across the control plate 318 at an upward offset angle $\alpha 1$ with respect to the vertical. The slot 320 includes a first end 322 (located generally in the middle portion of the plate 318) and a second end 324 located towards the right side of the plate 318 given its upward inclination). While FIG. 7 shows two first control plates 318, it is understood that any number of first control plates 318 may be used (e.g., a single first control plate 318).

Similarly, as shown in FIG. 8, the second locking member 308 includes a second control plate 326 coupled to and extending upward from the second frame 316. The second control plate 326 is located between the second locking button 310 and the second locking tab 312, and preferably about midway between the two 310, 312. The second control plate 326 includes a second control slot 328 that passes through the control plate 326 and that traverses across the control plate 326 at an upward offset angle $\alpha 2$ with respect to the vertical. The slot 328 includes a first end 330 (located generally in the middle portion of the plate 318) and a second end 332 located towards the left side of the plate 326 given its upward inclination). While FIG. 8 shows two second control plates 326, it is understood that any number of second control plates 326 may be used (e.g., a single second control plate 326).

With the first and second locking members 302, 308 concentrically combined as described above as shown in FIG. 10, the first and second control plates 318, 326 will align and overlay one another as shown. In addition, in this arrangement, the first end 322 of the first control slot 320 overlays the first end 330 of the second control slot 328 thereby forming a through-hole between the first and second plates 318, 326 (best seen in the rear overlaid plates 318, 326 in FIG. 10). To reiterate, in this arrangement, the can 102 is locked in place by the first and second locking tabs 306, 312.

Figure 11:
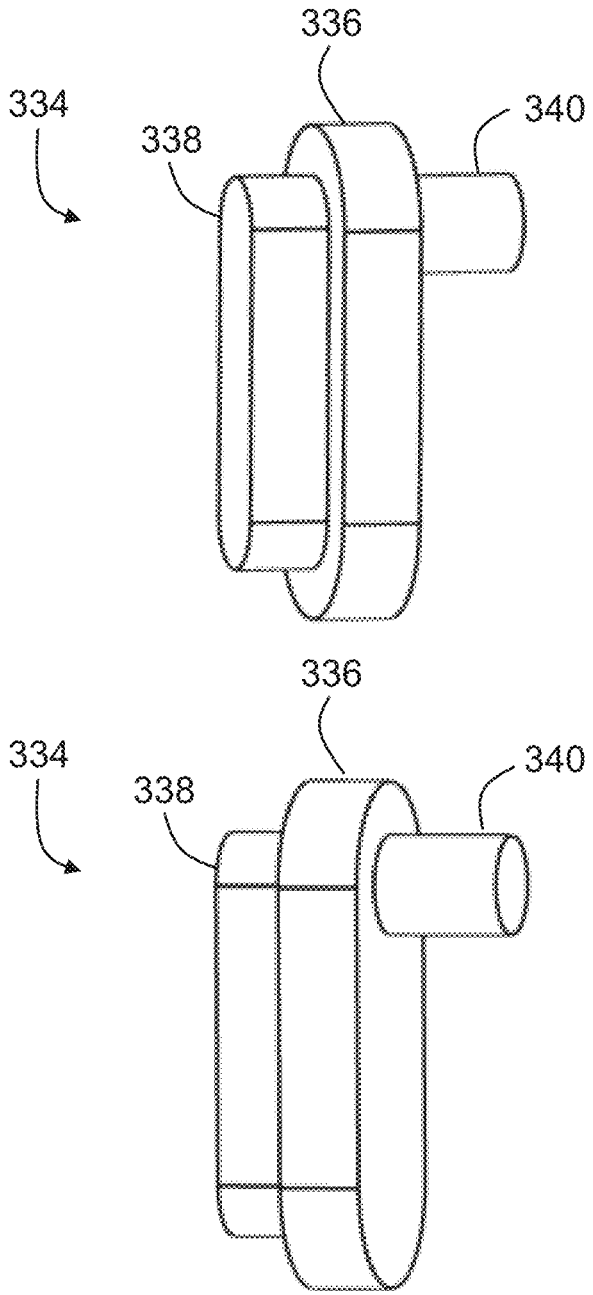
FIG. 11 shows aspects of a slider according to exemplary embodiments hereof.

In some embodiments, as shown in FIG. 10, a slider 334 is configured with the first and second control slots 328, 320. As shown in FIG. 11, the slider 334 includes a body 336, a tab 338 on a first side of the body 336, and a pin 340 on an opposite side (see FIG. 11 that shows the slider 334 from two different perspectives for clarity).

In some embodiments, as shown in FIG. 10, the slider 334 is configured with its pin 340 passing through the through-hole formed by the aligned first ends 322, 330 of the first and second control slots 320, 328, respectively. In this arrangement, the slider's tab 338 faces outward (e.g., towards an inner surface of the housing assembly 200).

Figure 12:
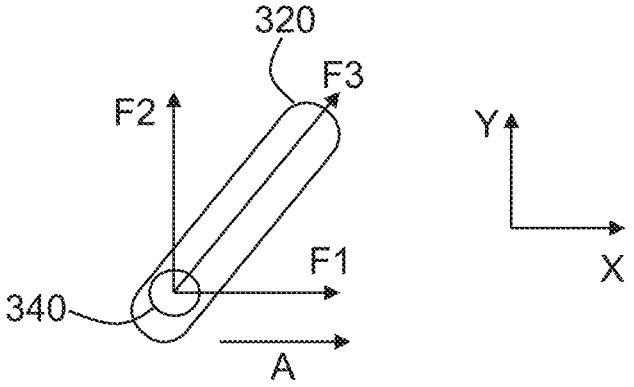
FIGS. 12-13 show aspects control slots according to exemplary embodiments hereof.

FIG. 12 shows the first control slot 320 configured with the slider's pin 340. Given the inclined orientation of the slot 320, a force F1 applied by the slot 320 to the pin 340 along the X-axis (due to its movement in the direction of the arrow A) is vectorially translated into a vertical force F2 along the Y-axis and an angular force F3 in the direction of the upward slot 320. Accordingly, as the slot 320 is moved in the direction of the arrow A, the force F3 causes the pin 340 to move upward within the slot 320 (in the direction of the force F3).

Figure 13:
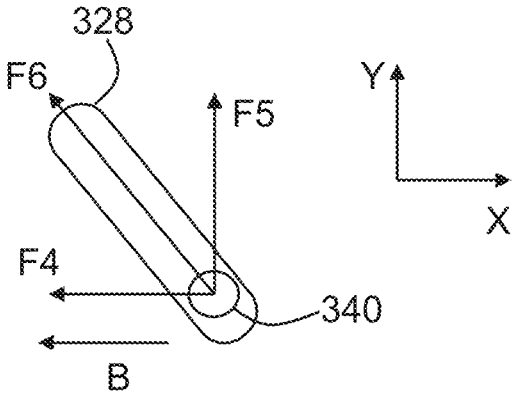

Similarly, FIG. 13 shows the second control slot 328 configured with the slider's pin 340. Given the inclined orientation of the slot 328, a force F4 applied by the slot 328 to the pin 340 along the X-axis (due to its movement in the direction of the arrow A) is vectorially translated into a vertical force F5 along the Y-axis and an angular force F6 in the direction of the upward slot 328. Accordingly, as the slot 328 is moved in the direction of the arrow B, the force F6 causes the pin 340 to move upward within the slot 328 (in the direction of the force F6).

However, with the first and second control plates 318, 326 overlaid as shown in FIG. 10, if the first force F1 is applied to the first plate 320 in the direction of the arrow A but the second control plate 328 is left stationary, movement of the first plate 318 will be blocked by the inability of the pin 340 to move upwards within the first slot 320 due to the second slot 328 obstructing its path. Similarly, if the fourth force F4 is applied to the second plate in the direction of the arrow B but the first plate 320 is left stationary, movement of the second plate 326 will be blocked by the inability of the pin 340 to move upwards within the slot 328 due to the first slot 320 obstructing its path.

In some embodiments, simultaneous movement of the first control plate 318 and its first control slot 320 in the direction of the arrow A and the second control plate 326 and its second control slot 328 in the direction of the arrow B results in upward forces F2, F5 being applied to the slider's pin 340 to move it upward. In addition, this simultaneous movement also dynamically aligns the intersection of the slots 320, 328 at the location of the pin 340 during the upward motion of the slider 334 thereby providing an unobstructed upward motion to the pin 340. Accordingly, as both buttons 304, 310 are simultaneously moved inward, restriction of the buttons' movement is removed and the buttons 304, 310 are free to move in the directions of the arrows A and B, respectively.

In some embodiments, as the first and second buttons 304, 310 move in the directions of the arrows A and B, respectively, the locking tabs 306, 312 also move in the directions of the arrows A and B, respectively, thereby releasing the lower surface of the can's circumferential rim 114. In this way, the can 102 is released downward from the locking assembly 300 and may be removed from the housing assembly 200 through the bottom.

Figure 14:
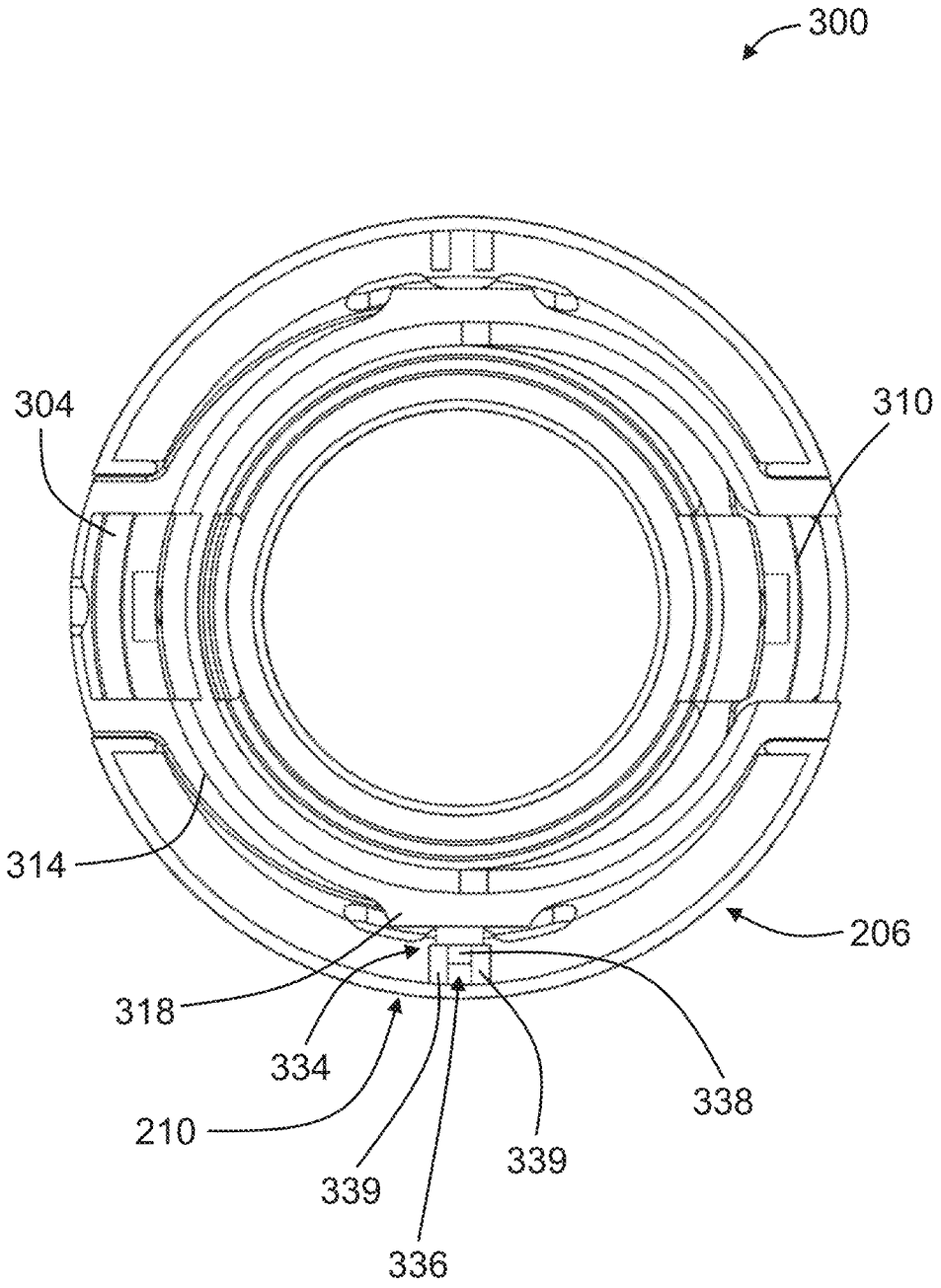
FIG. 14 shows a slider configured with a reusable container holder according to exemplary embodiments hereof.

FIG. 14 shows the locking assembly 300 of FIG. 10 looking into the assembly 300 from the bottom. FIG. 14 also shows the upper dispenser portion 206 and its outer shell portion 210 (see FIGS. 1 and 3) in which the locking assembly 300 is nested.

In some embodiments, as shown in FIG. 14, the inner surface of the upper dispenser's outer shell portion 210 (see also FIG. 3) includes a vertical guide channel 336 formed between two adjacent guide bars 339 (extending inward from dispenser's inner surface) designed to receive and guide the slider's outer tab 338 upwards as the slider's pin 340 is caused to move upwards due to the buttons 304, 310 being pushed inward. The guide channel 336 preferably allows the slider's tab 338 to only move vertically thereby preventing the tab 338 from becoming jammed during the inward movement of the control slots 320, 328.

While only one set of control plates 318, 326 and the associated elements have been described in detail, it is understood that the locking assembly 300 may include additional sets of control plates 318, 326 and associated elements, e.g., on the opposite side of the frames 314, 316 as shown in FIGS. 7-10.

Sealing Assembly 400

Figure 15:
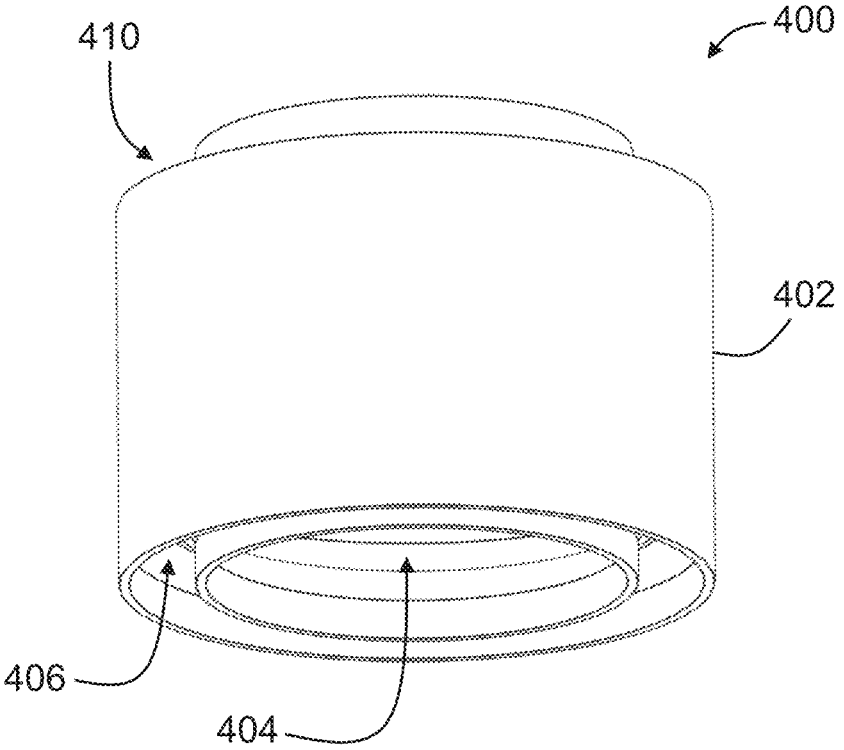
FIGS. 15-16 show aspects of a sealing body according to exemplary embodiments hereof.
Figure 16:
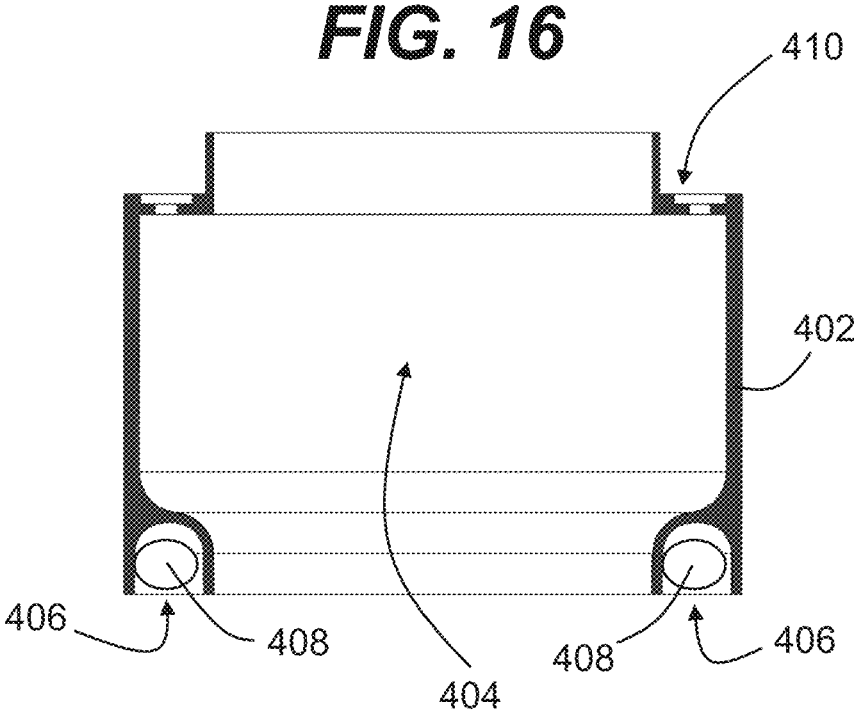

In some embodiments, as shown in FIG. 15, the sealing assembly 400 includes a cylindrical sealing body 402. As described below, the sealing body 402 is generally configured within the housing's dispenser portion 206. As shown in FIG. 3, the housing's dispenser portion 206 includes an outer shell portion 210, an inner spout portion 212, and a top cap portion 214. FIG. 15 shows a schematic of the sealing body 402 and FIG. 16 shows a side sectional view of the same In some embodiments, as shown in FIGS. 15-16, the sealing body 402 includes a first fluid passageway 404 extending through the body 402 from the top to the bottom, and a lower concentric channel 406 designed to receive and secure a seal ring 408. The sealing body 402 also includes an upper circumferential notch 410 about its upper surface.

As shown in FIG. 16, the seal ring 408 is held within the channel 406 so that a lower portion of the ring 408 is exposed. In this way, the seal ring 408 may be abutted against the upper rim 114 of the can 102 thereby providing a seal between the upper rim 114 and the sealing assembly 400 to prevent undesirable leaking of the contents of the can 102 during use.

Figure 17:
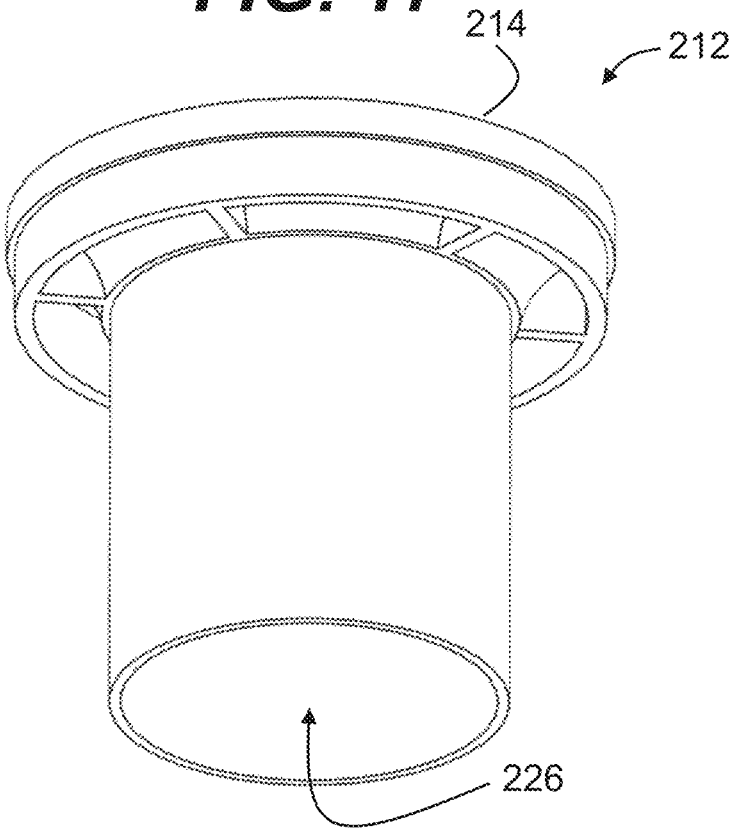
FIGS. 17-18 show aspects of a spout according to exemplary embodiments hereof.
Figure 18:
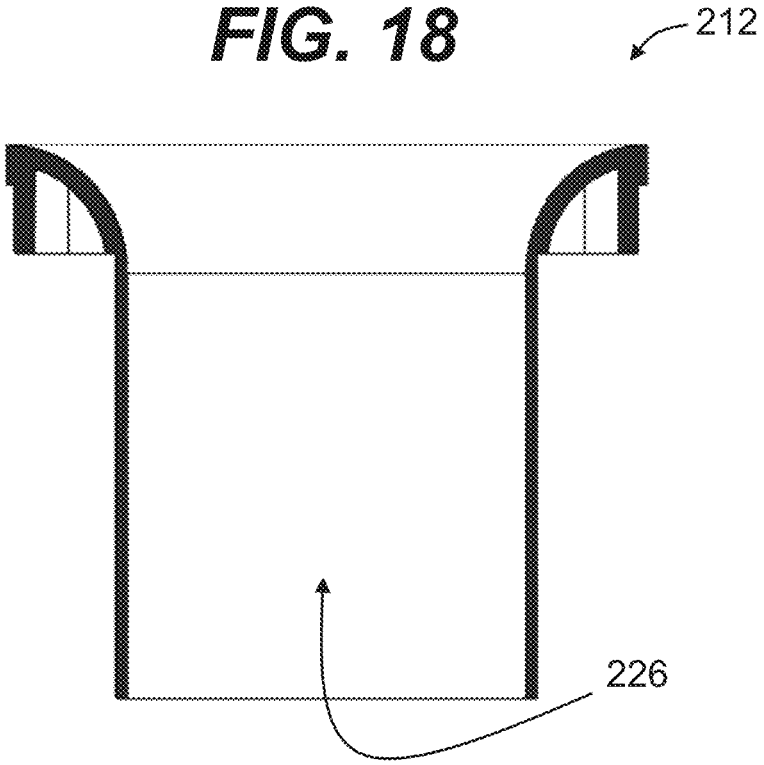
Figure 19:
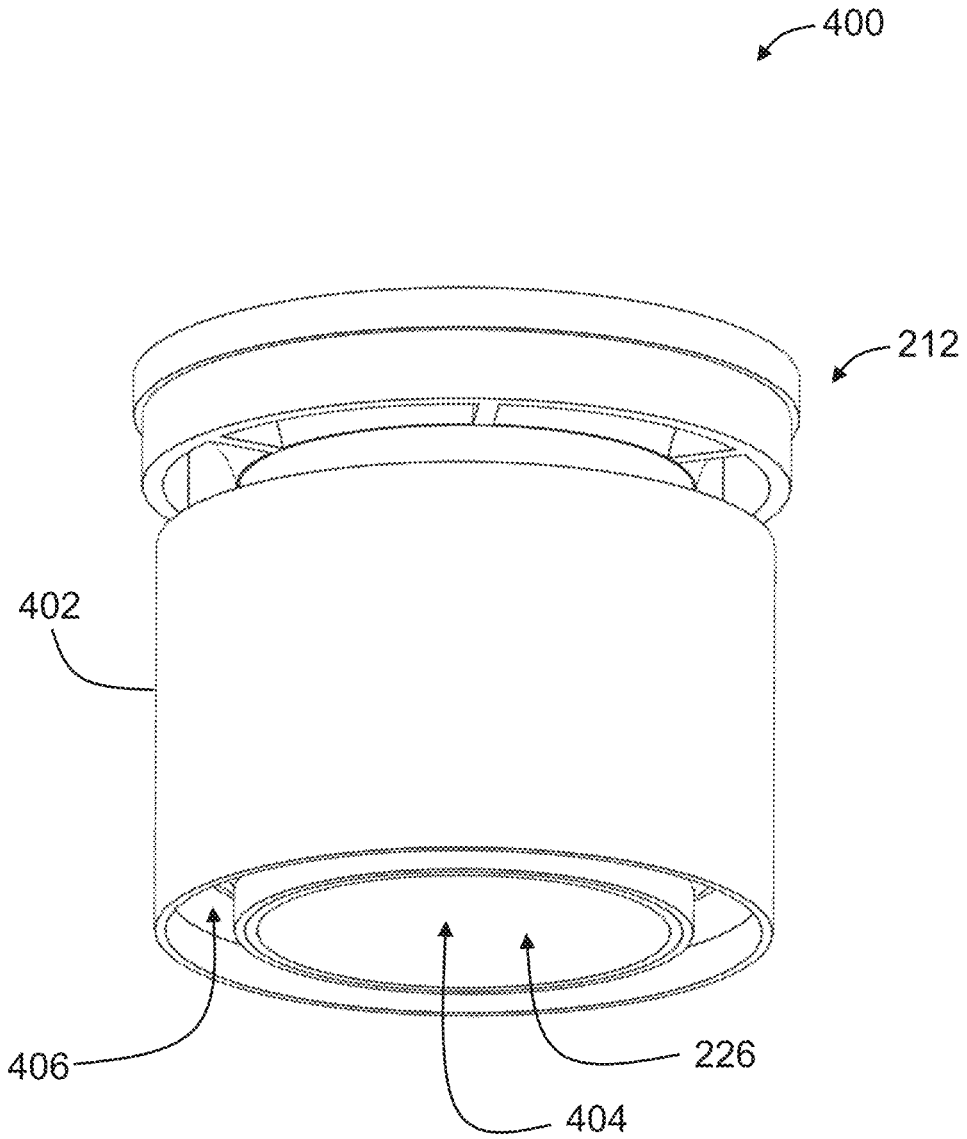
FIG. 19 shows aspects of a spout configured with a sealing body according to exemplary embodiments hereof.
Figure 20:
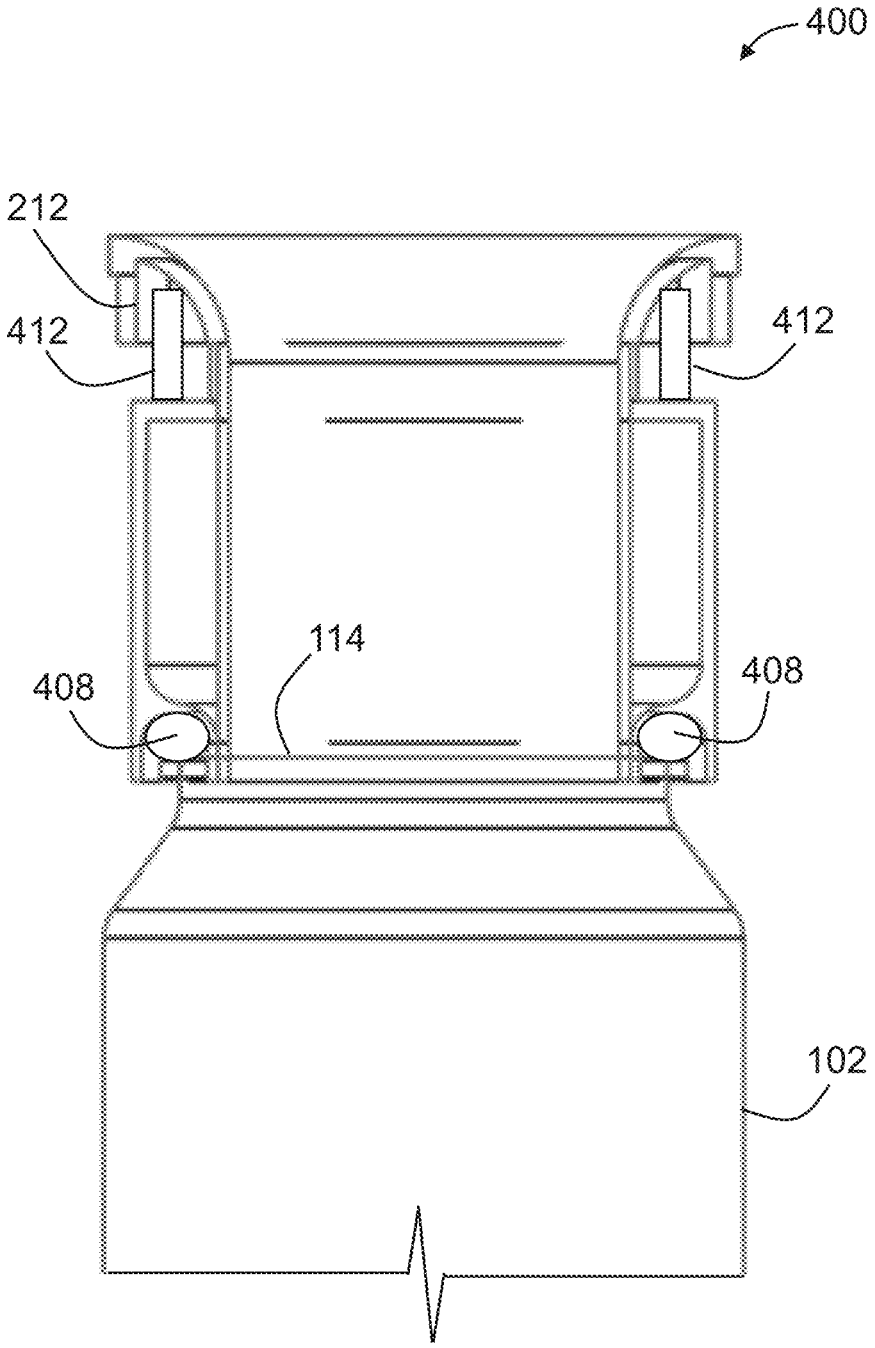
FIG. 20 shows aspects of a sealing body and a spout configured with a can according to exemplary embodiments hereof.

FIG. 17 shows a schematic of the housing's inner spout portion 214 and FIG. 18 shows a side sectional view of the same. FIG. 19 shows a schematic of the inner spout portion 214 configured concentrically within the sealing body 402, and FIG. 20 shows a side sectional view of the same. FIG. 20 also includes an upper portion of the can 102 showing its upper circumferential rim 114 configured with the sealing assembly 400.

In some embodiments, as shown in FIGS. 17 and 18, the inner spout portion 214 includes a second fluid passageway 226 that fits concentrically within the seal portion's passageway 220 (as shown in FIGS. 19-20) thereby providing a path for the contents of the can 102 (e.g., liquid detergent) to flow out from the can 102 and out the top of the dispenser portion 206. Also shown in FIG. 20 is the fluid-tight seal provided by this arrangement with the seal ring 224 abutted against the upper portion of the can's upper circumferential rim 114.

In some embodiments, as shown in FIG. 20, the sealing assembly 400 includes one or more tension mechanisms 412 disposed between its upper circumferential notch 410 and a downward facing surface of the inner spout portion 212. For example, in some embodiments, the spout portion 212 includes an upper flare to facilitate the controlled pouring of the can contents (e.g., the liquid detergent) beneath which may include a surface or other type of receptacle designed to hold an upper end of the tensioning mechanism 412. In some embodiments, the tensioning mechanism 412 includes a spring and/or any other suitable type of tensioning mechanism.

In some embodiments, the tensioning mechanism 412 provides a downward force to the sealing body 402 and to the sealing ring 408 coupled thereto. This downward force is designed to hold the sealing ring 408 against the can's upper circumferential rim 114 to ensure a fluid-tight seal between the ring 408 and the rim 114. In this way, the sealing assembly 400 ensures that the can 102 and the upper dispensing portion 206 remain in sealed contact regardless of slight inconsistencies in dimensions and shapes of the elements due to manufacturing tolerances and such.

In addition, in some embodiments, with the bottom cap 204 removed (as shown in FIG. 5), when the first and second control buttons 304, 310 are pressed inward simultaneously, the locking tabs 306, 312 may release the can's upper rim 114, and the downward force applied by the tension mechanisms 412 may generally eject the can 102 from the housing's hollow shell portion 202.

It is understood that any aspect and/or element of any embodiment of the assembly 10 described herein or otherwise may be combined in any way with any other aspect and/or element of any other embodiment to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A container holder for holding a container with an upper rim, the container holder comprising:

a housing including a housing first end, a housing second end opposite the housing first end, and housing sidewalls extending between the housing first end and the housing second end defining a housing inner volume;

a first locking member including a first locking member first end and a first locking member second end opposite the first locking member first end, a first locking button coupled to the first locking member first end, and a first locking tab coupled to the first locking member second end;

a second locking member including a second locking member first end and a second locking member second end opposite the second locking member first end, a second locking button coupled to the second locking member first end, and a second locking tab coupled to the second locking member second end;

a first control plate coupled to the first locking member between the first locking button and the first locking tab, the first control plate including a first control slot at a first offset angle with respect to a vertical axis;

a second control plate coupled to the second locking member between the second locking button and the second locking tab, the second control plate including a second control slot at a second offset angle with respect to the vertical axis;

wherein the first locking member first end is aligned with the second locking member second end, and the first locking member second end is aligned with the second locking member first end;

wherein the first control plate is overlaid with the second control plate forming a first passageway through the first control slot and the second control slot;

a control pin passing through the first passageway;

wherein a container with an upper rim is held within the housing by an engagement between the first locking tab and the upper rim and the second locking tab and the upper rim;

wherein the container with an upper rim is released from the housing when the first and second locking buttons are pressed inward thereby disengaging the first and second locking tabs from the upper rim.

2. The container holder of claim 1 wherein the first and second locking members are configured with the housing first end.

3. The container holder of claim 1 wherein the first control slot and the second control slot are at least partially overlaid to form the first passageway.

4. The container holder of claim 1 wherein the first locking member includes a first locking member aperture, and the second locking member includes a second locking member aperture, the first locking member aperture and the second locking member aperture overlaid to provide access to a top end of the container with an upper rim.

5. The container holder of claim 1 wherein a shape of the first locking member corresponds to a shape of the upper rim.

6. The container holder of claim 1 wherein a shape of the second locking member corresponds to a shape of the upper rim.

7. The container holder of claim 1 wherein the control pin is free to move upward with respect to the first and second control plates when the first and second buttons are simultaneously pressed inward.

8. The container holder of claim 1 wherein the control pin is obstructed from moving when the first locking button is pressed inward and the second locking button is not pressed inward.

9. The container holder of claim 1 wherein the control pin is obstructed from moving when the second locking button is pressed inward and the first locking button is not pressed inward.

10. The container holder of claim 1 further comprising:

a top lid adapted to cover the first end of the housing;

a sealing member configured with a lower portion of the top lid and adapted to engage the upper rim of the container with an upper rim;

a tension mechanism configured with the sealing member to apply a downward force to the sealing member.

11. The container holder of claim 10 wherein a shape of the sealing member corresponds to a shape of the upper rim.

12. The container holder of claim 10 wherein the top lid includes a spout.

* * * * *